US011610562B2

(12) United States Patent
Hur et al.

(10) Patent No.: US 11,610,562 B2
(45) Date of Patent: Mar. 21, 2023

(54) DISPLAY APPARATUS AND METHOD FOR CONTROLLING THE SAME

(71) Applicant: SAMSUNG ELECTRONICS CO., LTD., Suwon-si (KR)

(72) Inventors: Jaemyung Hur, Suwon-si (KR); Hojune Yoo, Suwon-si (KR); Minsup Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/015,607

(22) Filed: Sep. 9, 2020

(65) Prior Publication Data

US 2021/0082372 A1 Mar. 18, 2021

(30) Foreign Application Priority Data

Sep. 18, 2019 (KR) ..... 10-2019-0114481

(51) Int. Cl.
*G09G 5/10* (2006.01)
*G09G 3/36* (2006.01)

(52) U.S. Cl.
CPC ..... *G09G 5/10* (2013.01); *G09G 3/3607* (2013.01); *G09G 2320/0271* (2013.01); *G09G 2320/0666* (2013.01); *G09G 2360/141* (2013.01); *G09G 2360/144* (2013.01); *G09G 2370/16* (2013.01)

(58) Field of Classification Search
CPC ..... G09G 5/10; G09G 3/3607; G09G 2320/0271; G09G 2320/0666; G09G 2360/141; G09G 2360/144; G09G 2370/16
See application file for complete search history.

(56) References Cited

U.S. PATENT DOCUMENTS 7,460,210 B2 * 12/2008 Park ..... G03F 9/7026 355/72
8,379,060 B2 * 2/2013 Kwong ..... G09G 5/02 345/589

(Continued)

FOREIGN PATENT DOCUMENTS

| | | |
|---|---|---|
| JP | 9-81069 | 3/1997 |
| JP | 2013-218128 | 10/2013 |
| JP | 2016-137736 | 8/2016 |

OTHER PUBLICATIONS

International Search Report and Written Opinion dated Dec. 21, 2020 in corresponding International Application No. PCT/KR2020/011935.

(Continued)

*Primary Examiner* — Amare Mengistu
*Assistant Examiner* — Jennifer L Zubajlo
(74) *Attorney, Agent, or Firm* — Nixon & Vanderhye P.C.

(57) ABSTRACT

Disclosed is a display apparatus, capable of adjusting an image based on a location and a type of ambient light source. The display apparatus includes: a display; a housing supporting the display; a sensor disposed in the housing and configured to detect a quantity of entering light; and a processor configured to: based on an arrangement angle of the sensor and the detected quantity of the entering light, identify a location of a light source; and in response to the identified location of the light source, adjust a quality of an image displayed on the display.

18 Claims, 17 Drawing Sheets
(8 of 17 Drawing Sheet(s) Filed in Color)

(56) References Cited

U.S. PATENT DOCUMENTS

| | | | | |
|---|---|---|---|---|
| 2012/0182275 | A1* | 7/2012 | Chen | G09G 5/10 345/207 |
| 2013/0063471 | A1* | 3/2013 | Sugiyama | G09G 3/3406 345/589 |
| 2013/0076712 | A1* | 3/2013 | Zheng | G09G 5/10 345/207 |
| 2015/0186093 | A1* | 7/2015 | Kim | G06F 1/1677 345/174 |
| 2015/0192989 | A1* | 7/2015 | Kim | G06F 3/017 345/156 |
| 2016/0133227 | A1* | 5/2016 | Yoon | G09G 3/14 345/593 |
| 2017/0116962 | A1* | 4/2017 | Goodman | G01J 1/4204 |
| 2017/0263047 | A1 | 9/2017 | Mima | |
| 2018/0130429 | A1* | 5/2018 | Son | G09G 3/3413 |
| 2018/0373395 | A1* | 12/2018 | Kim | G01J 1/32 |
| 2018/0374408 | A1* | 12/2018 | Ma | G09G 3/2003 |
| 2019/0073964 | A1* | 3/2019 | Hong | G09G 3/3426 |
| 2019/0107392 | A1 | 4/2019 | Bosch et al. | |
| 2019/0108371 | A1 | 4/2019 | Moriki et al. | |

OTHER PUBLICATIONS

Extended European Search Report dated Jul. 22, 2022 for EP Application No. 20864483.1.

* cited by examiner

DISPLAY APPARATUS AND METHOD FOR CONTROLLING THE SAME

CROSS-REFERENCE TO RELATED APPLICATION

This application is based on and claims priority under 35 U.S.C. § 119 to Korean Patent Application No. 10-2019-0114481, filed on Sep. 18, 2019, in the Korean Intellectual Property Office, the disclosure of which is incorporated by reference herein in its entirety.

BACKGROUND

Field

The disclosure relates to a display apparatus, which is able to adjust a quality of image to be adapted to ambient light source environment, and a method for controlling the same.

Description of Related Art

Generally, a display apparatus recognizes an ambient brightness through an illumination sensor to set a proper brightness value, thereby allowing viewers not to interfere with watching an image. Such a prior art display apparatus uses only the illumination sensor to detect a change of the ambient brightness and to properly adjust an overall brightness of display screen.

However, since a quantity of light, which is reflected on each location of the display screen, is different according to a location of ambient light source, it is difficult or impossible for the display apparatus to sufficiently correct an effect of ambient light only by adjusting the overall brightness of the display screen. In particular, since in an extra-large display apparatus over, for example, 150 inches, the ambient light is more unevenly reflected on each location of the display screen, it is required to accurately correct the effect of ambient light.

Also, as the ambient light of the display apparatus, various light sources, such as a sunlight, a fluorescent lamp, a light bulb, a LED lamp, a neon lamp, etc. may be distributed. Since all kinds of light sources illuminate various colors of light, it is impossible to correct an effect according to the colors of the ambient light by adjusting the overall brightness of the display screen.

SUMMARY

Embodiments of the disclosure address various shortcomings of the prior art, and provide a display apparatus, which is able of adjusting an image according to a location and a kind of ambient light source, and a method for controlling the same.

An example embodiment of the disclosure may provide a display apparatus including: a display; a housing supporting the display; a sensor disposed in the housing and configured to detect a quantity of entering light; and a processor configured to: based on an arrangement angle of the sensor and the detected amount of entering light, identify a location of a light source; and in response to the identified location of the light source, adjust a quality of an image displayed on the display.

The sensor may include a plurality of sub sensors arranged at different angles with respect to a screen of the display, and the arrangement angle of the sensor may include arrangement angles of the plurality of sub sensors The sensor may include at least one of an illumination sensor or a color sensor.

The processor may be configured to apply a gradation effect to the image in response to the location of the light source.

The processor may be configured to apply a gradation effect to the image in response to the quantity of the entering light.

The processor may be configured to adjust a color of the image according to the location of the light source.

The display apparatus may further include a geomagnetic field sensor, and the processor may be configured to: identify an installation azimuth of the display apparatus using the geomagnetic field sensor; and based on the identified installation azimuth, identify the location of the light source.

The display apparatus may further include a Wi-Fi communication module comprising circuitry configured to perform Wi-Fi communication, and the processor may be configured to identify an installation region of the display based on connection information with an access point (AP) in performing of the Wi-Fi communication.

The display apparatus may further include: a second sensor configured to detect at least one of a wavelength or a frequency of the entering light, and the processor may be configured to: based on at least one of the detected wavelength or the detected frequency of the entering light, identify a type of the light source; and based on the identified type of the light source, adjust the quality of the image.

The processor may be configured to adjust a color of the image according to the type of the light source.

Another example embodiment of the disclosure may provide a display apparatus including: a display; a housing supporting the display; a sensor provided in the housing and configured to detect at least one of a wavelength or a frequency of entering light; and a processor configured to: based on at least one of the detected wavelength or the detected frequency of entering light, identify a type of a light source; and in response to the identified type of the light source, adjust a quality of an image displayed on the display.

The sensor may include a plurality of sub sensors arranged at different angles with respect to a screen of the display, and the processor may be configured to adjust a color of the image according to the type of the light source.

The sensor may include a plurality of sub sensors arranged at different angles with respect to a screen of the display, and the processor is configured to: based on arrangement angles of the sub sensors, identify a location of the light source; and adjust a color of the image according to the location of the light source.

According to an example embodiment of the disclosure a method of controlling the display apparatus may be provided, the method including: detecting, by a sensor arranged at a predetermined angle, a quantity of entering light; based on an arrangement angle of the sensor and the detected quantity of entering light, identifying a location of a light source; and adjusting a quality of an image displayed on a display of the display apparatus in response to the identified location of the light source.

According to an example embodiment of the disclosure a method of controlling a display apparatus may be provided, including: detecting at least one of a wavelength or a frequency of entering light; based on at least one of the detected wavelength or the detected frequency of entering light, identifying a type of a light source; and in response to the identified type of the light source, adjusting a quality of an image displayed on a display of the display apparatus.

BRIEF DESCRIPTION OF THE DRAWINGS

This patent or application file contains at least one drawing executed in color. Copies of this patent or patent application publication with color drawing(s) will be provided by the Office upon request and payment of the necessary fee.

The above and other aspects, features and advantages of certain embodiments of the present disclosure will be more apparent from the following detailed description, taken in conjunction with the accompanying drawings, in which.

DETAILED DESCRIPTION

Figure 1:
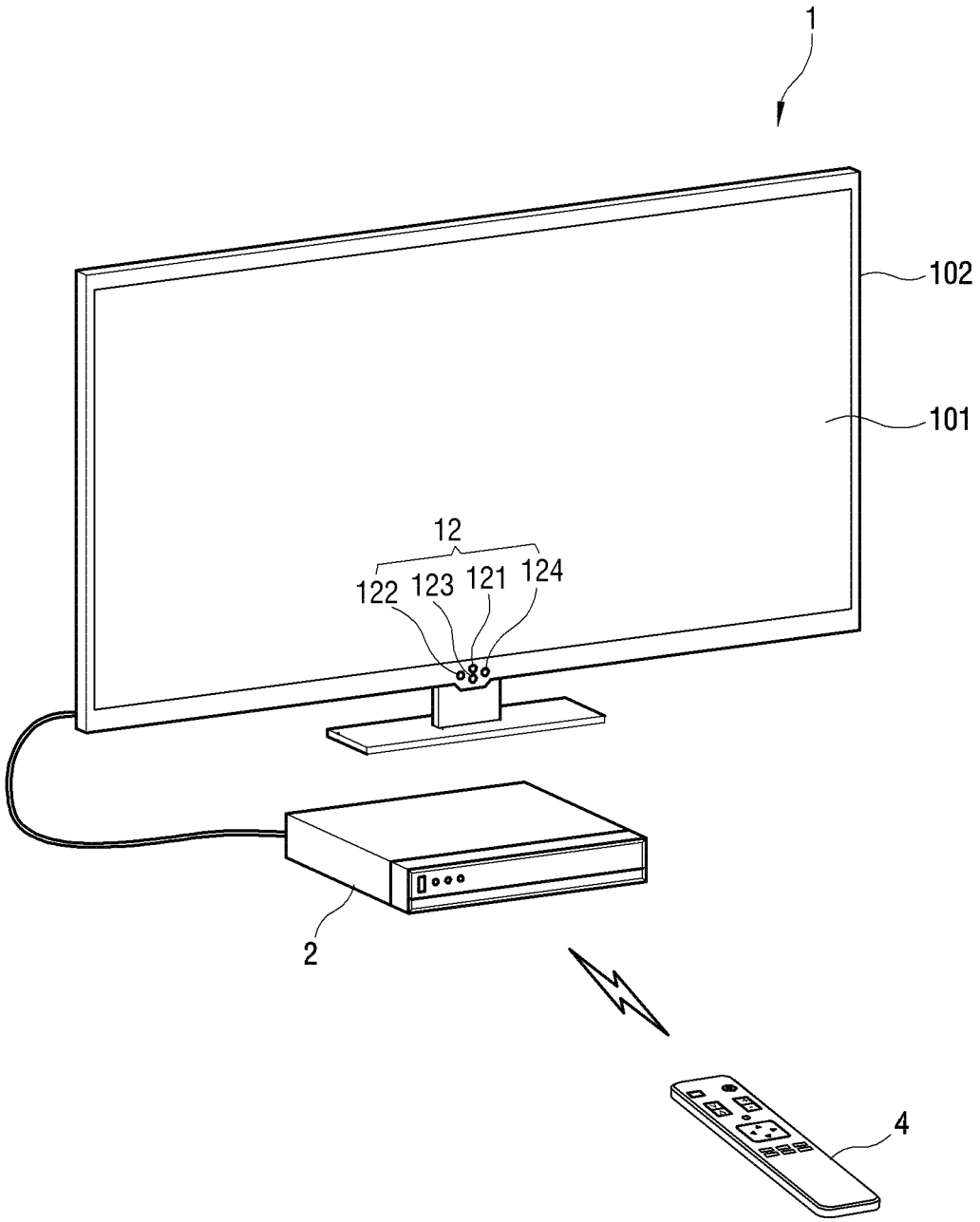
FIG. 1 is a front perspective view illustrating display apparatus according to an embodiment.

Below, various example embodiments will be described in greater detail with reference to the accompanying drawings. In the drawings, like numerals or symbols may refer to like elements having substantially the same function, and the size of each element may be exaggerated for clarity and convenience of description. However, the configurations and functions illustrated in the following example embodiments are illustrative, not limiting. In the following descriptions, details about known functions or features may be omitted if they are deemed to cloud the gist of the disclosure.

In the present disclosure, it will be understood that the terms "have", "may have", "include", "may include" etc. indicate a presence of corresponding features (for example, numerical values, functions, operations, or elements of parts or the like) and do not preclude the presence or addition of one or more other features.

In the present disclosure, the expression of "A or B", "at least one of A or/and B", or "one or more than of A or/and B" may include all possible combinations of elements listed together. For example, "A or B", "at least one of A and B", or "at least one of A and B" may refer to (1) including at least one A, (2) including at least one B, or (3) including both at least one A and at least one B.

In the following disclosure, the terms including ordinal numbers such as 'first', 'second' etc. are simply used to distinguish one element from another, and singular expressions include plural expressions are intended to include the expression of plural forms unless otherwise mentioned contextually.

In addition, in the following disclosure, it will be understood that the terms 'upper', 'lower', 'left', 'right', 'inner', 'outer', 'inside', 'outside', 'front', 'rear' etc. are defined based on the drawings, and do not limit shape or position of corresponding elements.

Further, in the present disclosure, the expression of "configured to (or set to)" may for example be used interchangeably with "suitable for," "having the capacity to," "designed to," "adapted to," "made to," or "capable of". Also, the expression of "configured to (or set to)" may not necessarily refer to only "specifically designed to" in terms of hardware. Instead, the "apparatus configured to" may refer, for example, to "capable of" along with other devices or parts in a certain circumstance. For example, the phrase of "the sub processor configured to (or set to) perform A, B, and C" may refer, for example, and without limitation, to a dedicated processor (e.g. an embedded processor) for performing the corresponding operations, or a generic-purpose processor (e.g. a central processing unit (CPU) or an application processor) for performing the corresponding operations by executing one or more software programs stored in a memory device.

In the present disclosure, a display apparatus according to many embodiments may include, for example, and without limitation, at least one of a television (TV), a signage, a smartphone, a tablet personal computer (PC), a video telephone, an electronic book reader, a desktop PC, a laptop PC, a netbook computer, a workstation, a personal digital assistant (PDA), an electronic picture frame, etc. which are capable of receiving various types of content.

In the present disclosure, the term 'user' may refer, for example, to a person of using the display apparatus or a device (for example, an artificial intelligence electronic apparatus) of using the display apparatus 1.

FIG. 1 is a front perspective view illustrating an example display device 1 according to an embodiment of the present disclosure. The display device 1 may receive a content from a certain content provider. For example, and without limitation, the display apparatus 1 may be implemented by a TV, which receives an image content from a content supplying device 2, such as a set-top box, or by streaming from a server via a network, and which is able to be controlled by an infrared (IR) signal received from a remote controller 4. Of course, the display apparatus 1 is not limited only to the TV, and may be implemented by various electronic devices, which use many kinds of contents provided by content providers. Also, the display apparatus 1 may not be provided with a display for displaying an image, but output the image to, for example, an output device, such as a monitor, a TV or the like, via an image interface, such as a high definition multimedia interface (HDMI), a display port (DP), a Thunderbolt or the like.

As shown in FIG. 1, the display apparatus 1 may include a screen 101 displaying an image, a housing 102 surrounding the screen 101, and a sensor 12 provided on the housing 102 in the front of the screen 101 to detect ambient light. The sensor 12 may, for example, be disposed on a portion of the housing 102 located on a middle of a bottom of the screen 101, as shown in FIG. 1. Also, in an extra-large display apparatus, a plurality of sensors may be disposed on portions of the housing located on four corners of the screen and middles of the top and the bottom of the screen.

The sensor 12 may include, for example, a camera 121, an illumination sensor 122, an IR transceiver 123 and a color sensor 124.

The content supplying device 2 may transmit, to the display apparatus 1, an image content and/or an electronic program guide user interface (EPG UI), which is provided by the content provider according to a request. The content supplying device 2 may include a set-top box provided by the content provider, a broadcasting station transmitting broadcast signals, a cable station supplying contents over a cable, a media server supplying media over an internet, and the like.

Figure 2:
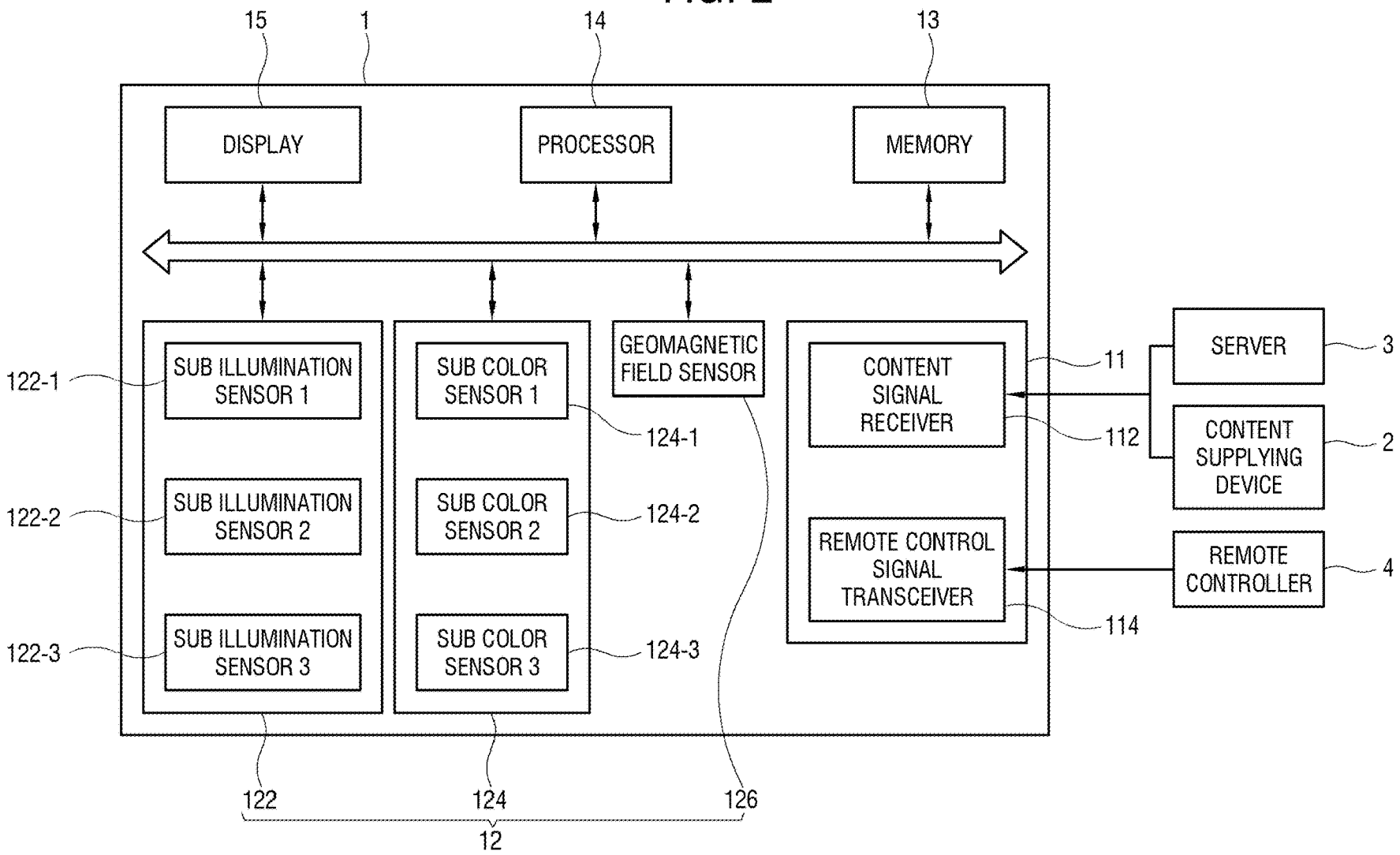
FIG. 2 is a block diagram illustrating an example configuration of the display apparatus of FIG. 1 according to an embodiment.

FIG. 2 is a block diagram illustrating an example configuration of the display apparatus 1 of FIG. 1. The display apparatus 1 may include a signal input and output module (e.g, including input/output circuitry) 11, a sensor 12, a memory 13, a processor (e.g., including processing circuitry) 14 and a display 15. The display apparatus 1 may further include a microphone (not shown) for inputting voices, an input receiver (not shown), a voice processor (not shown), an image processor (not shown), a speaker (not shown) and the like.

The signal input and output module 11 may include various input/output circuitry, including, for example, and without limitation, a content signal receiver 112, and a remote control signal transceiver 114.

The content signal receiver 112 may include various circuitry and receives content signals from, for example, and without limitation, a public TV station, a cable station, a media broadcasting station and the like. The content signal receiver 112 may receive the content signals from an exclusive content supplying device 1 such as a set-top box, or a personal mobile terminal such as a smartphone. The content signals received by content signal receiver 112 may be wired signals or wireless signals, and digital signals or analog signals. Also, the content signals may be public TV signals, cable signals, satellite signals, or network signals. The content signal receiver 112 may further include a universal serial bus (USB) port for connecting a USB memory thereto and the like. The content signal receiver 112 may be implemented by a HDMI, a DP, a Thunderbolt, or the like, which is a port capable of simultaneously receiving image and voice signals. Of course, the content signal receiver 112 may include an input port receiving the image and voice signals and an output port outputting the image and voice signals. Also, the image and voice signals may be transmitted and received together or independently.

The content signal receiver 112 may receive image signals of any one among a plurality of channels according to control of the processor 14. The image signals may contain an image content and/or an EPG UI, which is provided by the content provider. The image content may include broadcasting programs, which include various genres such as drama, movie, news, music, video on command (VOD) and the like, and contents thereof are not limited.

The content signal receiver 112 may perform network communications with the content supplying device 2, the server 3 and other devices via an access point. To perform wireless communication, the content signal receiver 112 may include a radio frequency (RF) circuit, which transmits and receives RF signals. The content signal receiver 112 may include a communication module including various communication circuitry, such as, for example, and without limitation, one or more than among Wi-Fi, Bluetooth, Zigbee, ultra-wide band (UWB), wireless USB, and near field communication (NFC). The content signal receiver 112 may perform wired communications via a wired local area network (LAN). The content signal receiver 112 may be implemented in many other communication ways besides a connection part including a connector or terminal for wired connection.

The remote control signal transceiver 114 may include various circuitry and receives remote control signals, including, for example, and without limitation, IR signals, Bluetooth signals, Wi-Fi signals, or the like. Also, the remote control signal transceiver 114 may transmit IR signals, Bluetooth signals, Wi-Fi signals, or the like, which include command information for controlling an external device, such as the content supplying device 2.

The display apparatus 1 may include exclusive communication modules, which exclusively perform communications with respect to each of the content supplying device 2, the server 3, and the remote controller 4. For example, the content supplying device 2, the server 3, and the remote controller 4 may perform the communications through a HDMI module, an Ethernet modem or a Wi-Fi module, and a Bluetooth module or an IR module, respectively.

The display apparatus 1 may include a common communication module, which performs communications with all of the content supplying device 2, the server 3, and the remote controller 4. For example, the content supplying device 2, the server 3, and the remote controller 4 may perform the communications through a Wi-Fi module.

Besides the content signal receiver 112, the display apparatus 1 may include a content signal output including various output circuitry, which outputs content signals to the outside. Here, the content signal receiver 112 and the content signal output may be implemented to be integrated into one module or in separate modules.

The sensor 12 may include an illumination sensor 122 measuring or detecting a quantity of light according to an incident angle of light entering onto the screen, a color sensor 124 detecting a color of light entering onto the screen, and a geomagnetic field sensor 126 detecting an azimuth of the display apparatus 1.

The illumination sensor 122 may be implemented, for example, by a photoconductive type sensor, which uses, for example, a cadmium sulfide (CDS) as a photoconductor. The illumination sensor 122 as a sub sensor may include three sub illumination sensors 122-1, 122-2 and 122-3, which are provided in a given arrangement angle, for example, 45°, on a front surface of the display apparatus 1. Of course, the illumination sensor 122 may include two, four, or more than sub illumination sensors. Also, the three sub illumination sensors 122-1, 122-2 and 122-3 may be arranged in various angles.

The three sub illumination sensors 122-1, 122-2 and 122-3 may receive light entering or joining from directions, which are head-on with respect to the screen and angles of 45 degrees to the left and the right with respect to the head-on direction of the screen, respectively. The three sub illumination sensors 122-1, 122-2 and 122-3 may detect a quantity of light joining from the directions as described above.

Instead of the given angles to the left and the right with respect to the head-on direction of the screen, the plurality of sub illumination sensors may be provided in arrangements, which are given angles up and down with respect to the head-on direction of the screen, respectively. Also, the plurality of sub illumination sensors may be provided in arrangements, which are head-on with respect to the screen, given angles to the left and the right with respect to the head-on direction of the screen, and given angles up and down with respect to the head-on direction of the screen, respectively.

The color sensor 124 may include, for example, an optical sensor, which detects an inherent wavelength band in which a white light is included. The color sensor 124 may include an integrated color sensor in which three single color sensors of RGB are integrated, and a multilayer color sensor in which two diodes are formed lengthwise.

The color sensor 124 may include, for example, three sub color sensors 124-1, 124-2 and 124-3, which are provided in a given arrangement angle, for example, 45°, on the front surface of the display apparatus 1. Of course, the color sensor 124 may include one, two, four or more than sub color sensors.

The three sub color sensors 124-1, 124-2 and 124-3 may receive light joining from directions, which are head-on with respect to the screen and angles of 45 degrees to the left and the right with respect to the head-on direction of the screen, respectively. The three sub color sensors 124-1, 124-2 and 124-3 may detect a color of light joining from the directions as described above.

Instead of the given angles to the left and the right with respect to the head-on direction of the screen, the plurality of sub color sensors may be provided in arrangements, which are given angles up and down with respect to the head-on direction of the screen, respectively. Also, the plurality of sub color sensors may be provided in arrangements, which are head-on with respect to the screen, given angles to the left and the right with respect to the head-on direction of the screen, and given angles up and down with respect to the head-on direction of the screen, respectively.

The geomagnetic field sensor 126 may include various circuitry to determine an azimuth where the display apparatus 1 is placed.

The memory 13 may include a computer-readable recording medium that stores unlimited data. The memory 13 is accessed by the processor 14 and controlled to read, write, modify, delete, and update data by the processor 14. The data stored in the memory 13 may include, for example, data of compensation brightness or color corresponding to the quantity or the color of entering light.

The memory 13 may include a light source position identification module, which is executable by the processor 14 and which identifies a position of the light source based on the quantity of light according to the incident angle of light, information about time and azimuth where the display apparatus 1 is placed measured by the geomagnetic field sensor 126, and connection information between the Wi-Fi module and the AP. The memory 13 may include a light source kind identification module, which is executable by the processor 14 and which identifies a kind or type of the light source according to the wavelength or frequency of light detected by the color sensor 126. The memory 13 may include a light source compensation module, which discriminatively adjusts a quality of image, for example, a brightness of image, by screen positions according to the position and the kind of the light source and adjusts a color of image according to the color of entering light.

The memory 13 may include a voice recognition module (voice recognition engine), which recognizes received voice. Of course, the memory 13 may include an operating system (OS), and various applications, image data, additional data and so on, which are executable on the OS.

The memory 13 may include, for example, a nonvolatile memory in which a control program is installed and a volatile memory in which at least a portion of the installed control program is loaded.

The memory 13 may include, for example, a storage medium of at least one type among a flash memory type, a hard disk type, a multimedia card micro type, a card-type memory (e.g. a secure digital (SD) or extreme digital (XD) memory), a random access memory (RAM), a static random access memory (SRAM), a read only memory (ROM), an electrically erasable programmable read-only memory (EEPROM), a programmable read-only memory (PROM), a magnetic memory, a magnetic disc, and an optical disc.

The processor 14 may include various processing circuitry and control respective elements of the display apparatus 1. The processor 13 may control, for example, to display received image on the display 15 built in or disposed outside the display apparatus 1 according to a request of the user.

The processor 14 may execute the light source position identification module stored in the memory 13 thus to identify the position of the light source based on the quantity of light according to the incident angle of light detected by the illumination sensor 122, the information about time and azimuth where the display apparatus 1 is placed detected by the geomagnetic field sensor 126, and the connection information between the Wi-Fi module and the AP.

The processor 14 may execute the light source kind identification module stored in the memory 13 thus to identify the kind of the light source according to the wavelength or frequency of light detected by the color sensor 124.

The processor 14 may execute the light source compensation module stored in the memory 13 to control the display 15 to discriminatively adjust a quality of image, for example, a brightness of image, by screen positions according to the position of the light source and compensate the color of image according to a color of entering light identified by the kind of the light source. For example, the processor 14 may control the brightness of image, so that it is increased at a brighter portion thereof and lowered at a darker portion thereof based on the quantity of light according to the incident angle of light. Also, the processor 14 may adjust image data using complementary color contrast if light having a wavelength of, for example, yellow tone enters.

The processor 14 may include, for example, and without limitation, at least one general purpose processor, which loads at least a portion of the control program onto the volatile memory from the nonvolatile memory in which the control program are installed, and executes the loaded at least a portion of the control program. The processor 14 may be implemented by, for example, a central processing unit (CPU), an application processor (AP), or a microprocessor.

The processor 14 may include a single core, a dual core, a triple core, a quad core, and a core of multiple thereof. The processor 14 may include a plurality of processors. The processor 14 may include, for example, a main processor, and a sub processor operating only in a sleep mode (for example, a mode in which only standby power is supplied). Also, the processor, the ROM, and the RAM are interconnected through an inner bus.

The processor 14 may be implemented in the form of being included in a main system-on-a-chip (SoC), which is mounted on a printed circuit board (PCB) contained in the display apparatus 1. In another embodiment, the main SoC may further include an image processor.

The control program may include a program (or programs) which is implemented in the form of at least one of a BIOS, a device driver, an OS, a firmware, a platform, and an application program (application). The application program may be installed or stored in advance in the display apparatus 1 in manufacturing, or installed in the display apparatus 1 based data thereof received from an external apparatus in use. The data of the application program may be downloaded to the display apparatus 1 from an outer server, such as, for example, an application market or the like. The outer server is an example of a computer program product, but is not limited thereto.

The display 15 may, for example, display an image based on an image signal, which is processed by the processor 14. The display 15 mat display an image, which is stored in the memory 13 or received from the content supplying device 2 or the server 3 via the signal input and output 11.

The display 15 may display an image signal, which is corrected from the stored or the input image signal considering the identified location and/or kind of the light source, by the processer 14.

Implemented types of the display 15 are not limited. For instance, the display 15 may be implemented in various display panels, such as, for example, and without limitation, liquid crystal display (LCD), plasma display panel (PDP), light-emitting diode (LED) display, organic light emitting diodes (OLED) display, surface-conduction electron-emitter, carbon nano-tube, nano-crystal display, etc.

The display 15 may include additional constructions according the implemented types. For instance, if the display 15 is a LCD type, it may include a LCD panel, a panel driving board driving the LCD panel, and a backlight unit supplying light to the LCD panel. The LCD panel may include a color filter expressing a color of image.

Figure 3:
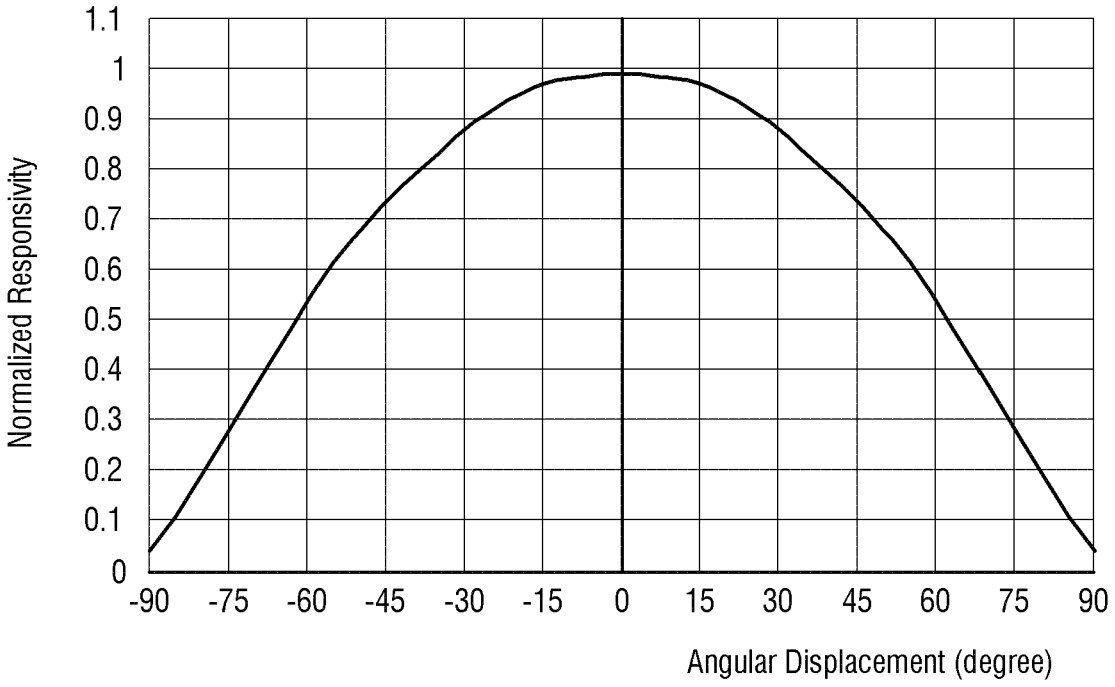
FIG. 3 is a graph illustrating an example quantity of entering light according to an arrangement angle of an illumination sensor according to an embodiment.

FIG. 3 is a graph, illustrating an example quantity of entering light according to an arrangement angle of the illumination sensor 122 according to an embodiment.

Referring to FIG. 3, the quantity of light entering the illumination sensor 122 is normalized to 1 when the location or position of the light source (sun) is an angle of 0 degree, e.g., the quantity of light entering in the head-on direction of the illumination sensor 122 is maximum, and 0 when the location of the light source (sun) is an angle of 90 degrees left and light from the head-on direction of the illumination sensor 122, e.g., parallel to the plane of the illumination sensor 122, so that there is no quantity of entering light. Accordingly, it is possible to accurately identify the location of the light source based on the quantity of light entering into the illumination sensor 122.

Figure 4:
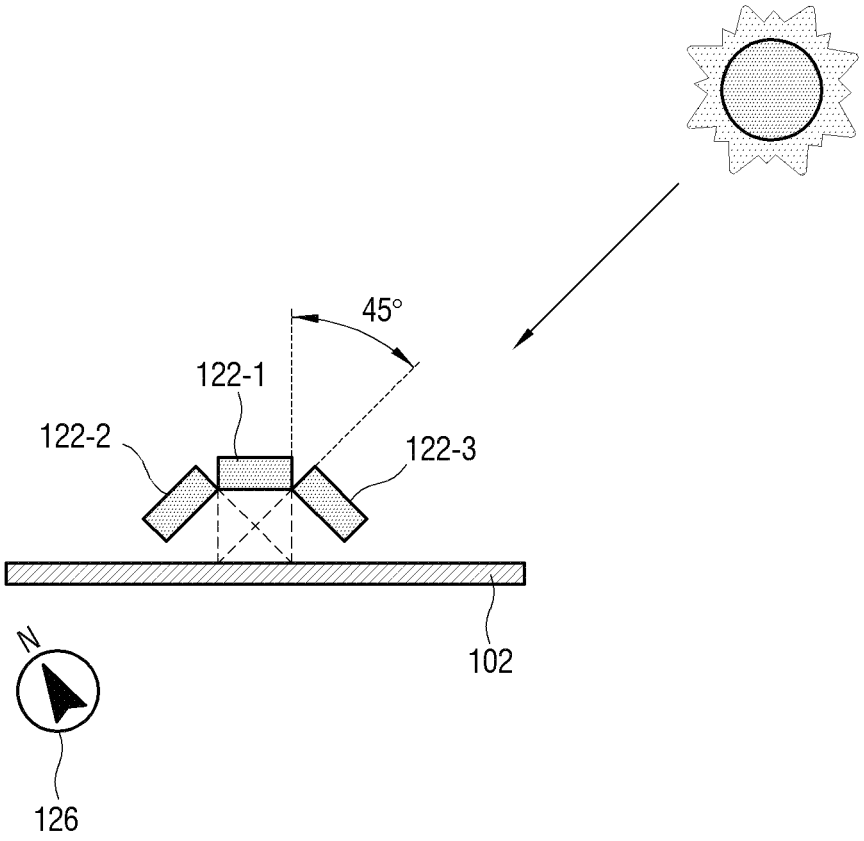
FIG. 4 is a diagram illustrating an example state in which first to third sub illumination sensors are arranged head-on, at an angle of 45 degrees in the left direction, and at an angle of 45 degrees in the right direction, respectively, according to an embodiment.

FIG. 4 is a diagram illustrating an example state in which first to third sub illumination sensors 122-1, 122-2, and 122-3 are arranged head-on, at an angle of 45 degrees in the left direction, and at an angle of 45 degrees in the right direction, respectively, according to an embodiment of the present disclosure.

Referring to FIG. 4, if a ratio of the quantity of light entering the first to third sub illumination sensors 122-1, 122-2, and 122-3 is, for example, 30:0:85, since in FIG. 3, the normalized responsivity is about 0.3 when the angle of the light source is 75 degrees to the right and about 0.85 when the angle is 30 degrees to the right, it can be appreciated that the sunlight enters in the angle of 75 degree to the right from the front surface.

The geomagnetic field sensor 126 may present time information and azimuth of the display apparatus 1. Also, based on connection information between the Wi-Fi module and the AP, e.g., internet protocol (IP) address, a region where the display apparatus 1 is located in present may be identified.

As a result, the processor 14 may identify the azimuth of the display apparatus 1, the region information, the time information and the location of the sunlight based on the arrangement of the display 15, thereby adjusting a quality of the image displayed in the display 15.

Figure 5:
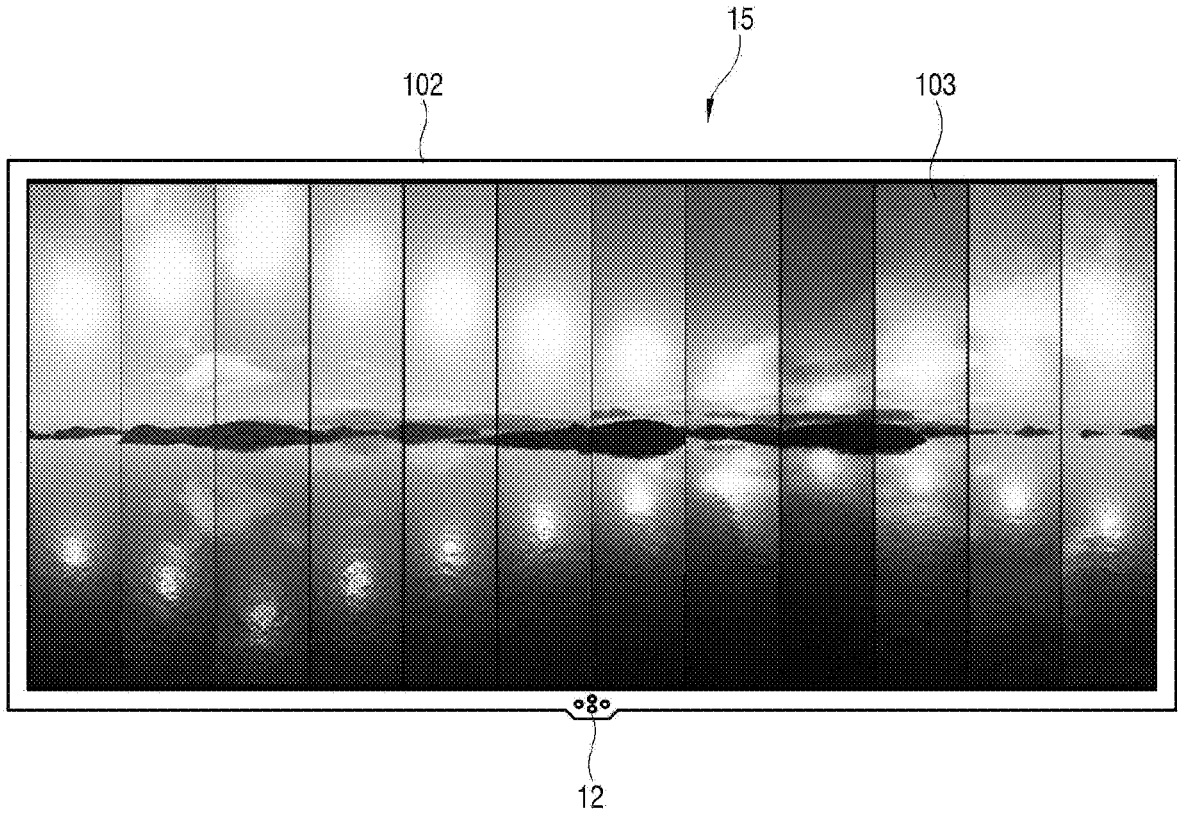
FIG. 5 is a diagram illustrating an example user interface (UI), which adjusts a quality of an image displayed on a display based on a location of a light source according to an embodiment.

FIG. 5 is a diagram illustrating an example user interface (UI) 103, which adjusts the quality of the image displayed on the display 15 based on the location of the light source according to an embodiment of the present disclosure.

Referring to FIG. 5, the display 15 may provide a UI to which a gradation effect changing in real time according to time and direction of the sun is applied.

As another embodiment, the display 15 may provide a UI 103 to which a gradation effect changing in real time according to time and a quantity of incident light by location is applied. In other words, assuming that the sub illumination sensors 122-1, 122-2, and 122-3 are provided on a center of a horizontal side of the screen, light volumes on the left end and the right end of the screen may be identified based on light volumes entering the sub illumination sensors 122-1, 122-2, and 122-3 on the center of the horizontal side of the screen. As a result, the processor 14 may identify a ratio of the light volumes from the left end to the right end of the screen thus to more precisely correct a quality of image, e.g., a brightness of image, or to provide the UI 103 to which the gradation effect is applied.

Figure 6:
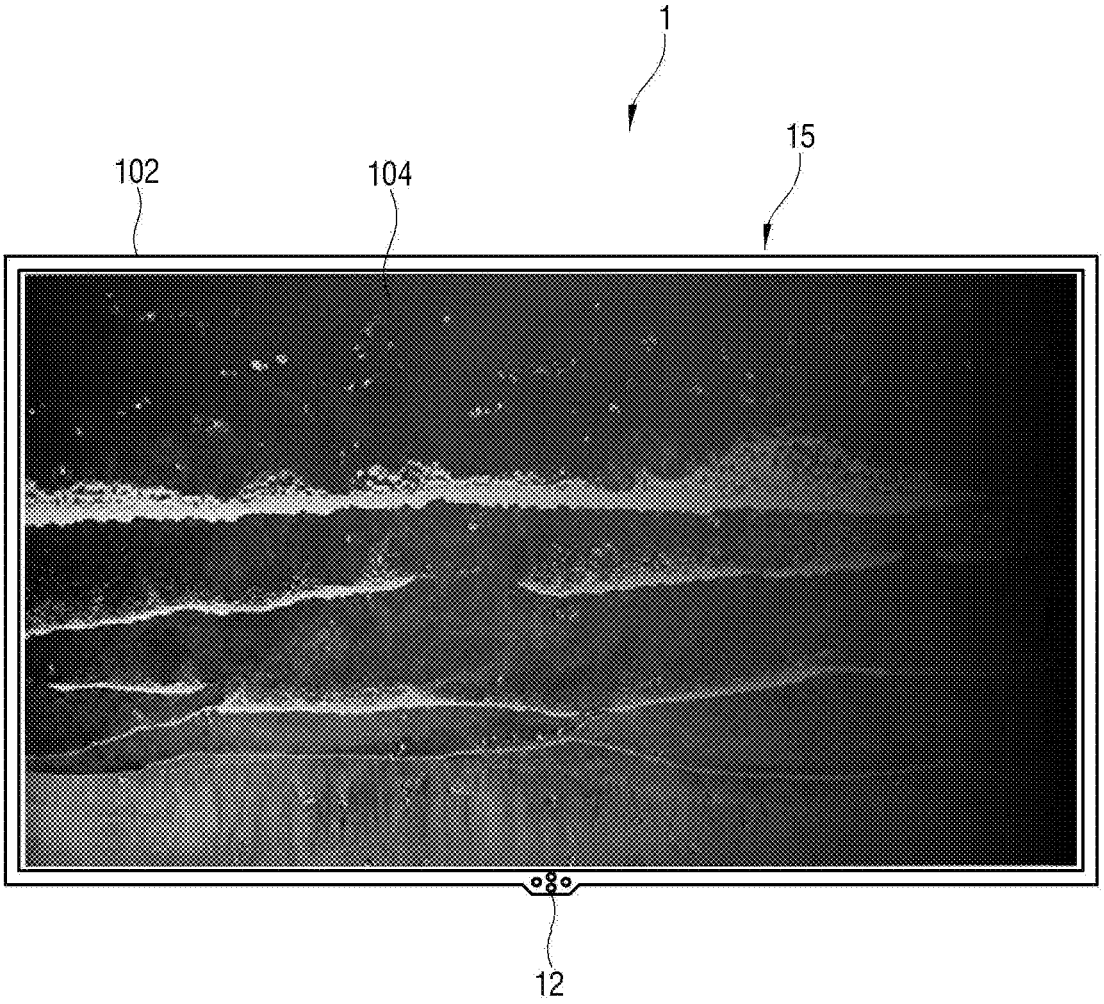
FIG. 6 is a diagram illustrating an example image showing a scene when a light source is located on the left side according to an embodiment.
Figure 7:
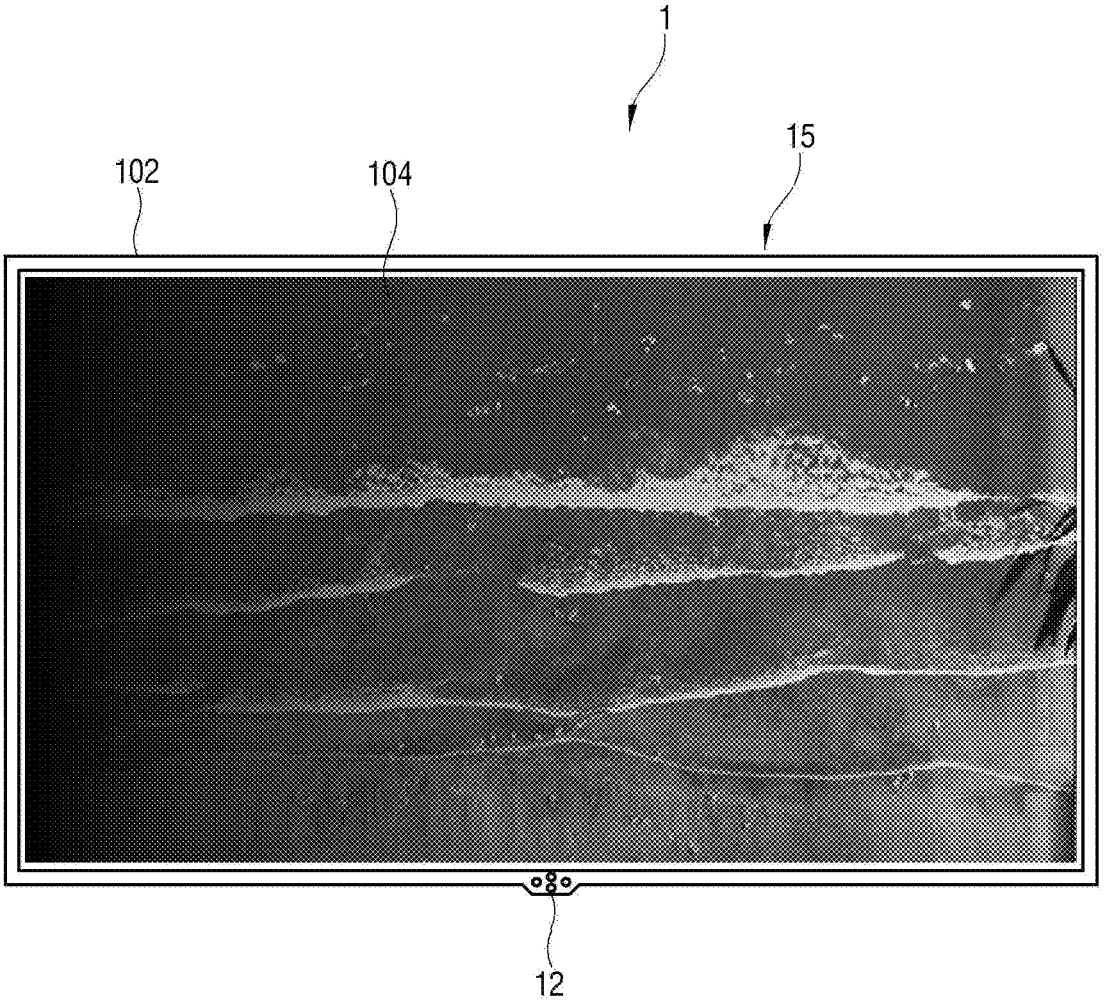
FIG. 7 is a diagram illustrating an example image showing a scene when a light source is located on the right side according to an embodiment.

FIGS. 6 and 7 are diagrams illustrating example scenes 104 when the light source is located on the left side and the right side, respectively, according various embodiments.

Referring to FIG. 6, the display apparatus 1 may provide special watching environment in which in the scene 104 that represents a beach at dark night, the light source located on the left side illuminate the beach.

Referring to FIG. 7, the display apparatus 1 may provide special watching environment in which in the scene 104 that represents the beach at dark night, as shown in FIG. 6, the light source located on the right side illuminate the beach.

The special watching environments shown in FIGS. 6 and 7 may be provided by adding an image adjusting signal of the display 15 to which the location of the light source in certain time is considered for each specific scene 104 by an audiovisual producer or a vision mixer.

Figure 8:
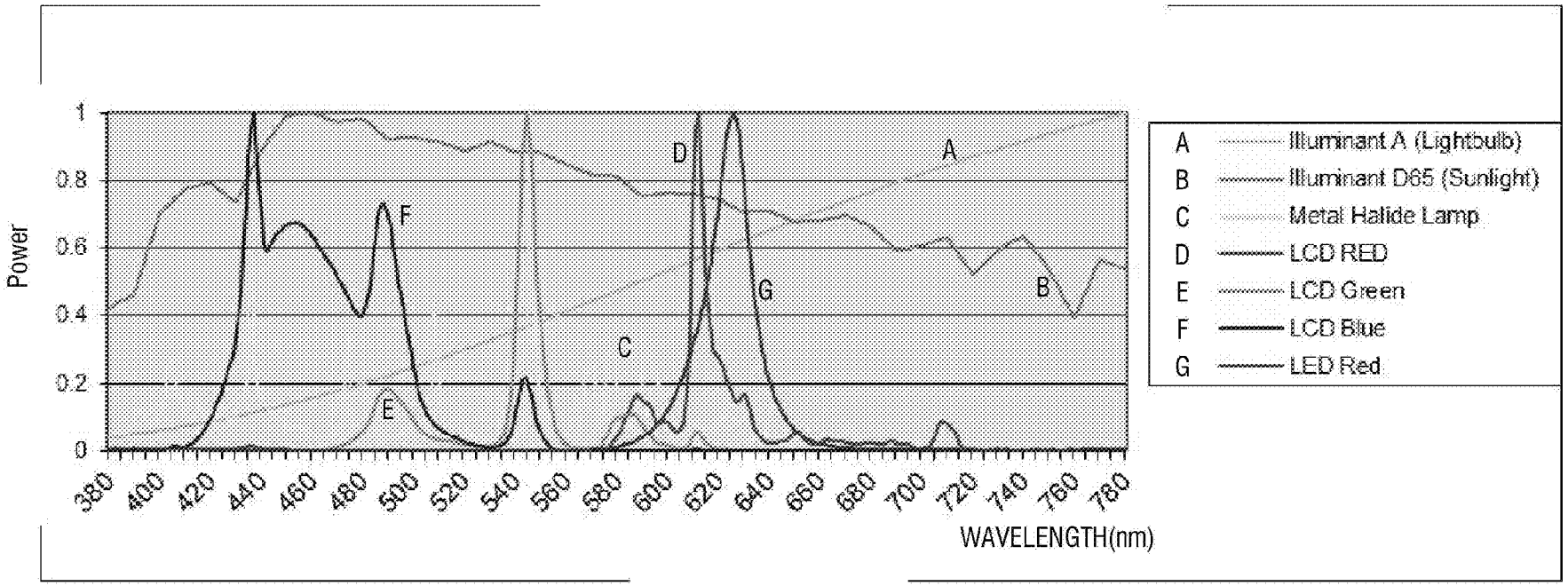
FIG. 8 is a graph illustrating example spectrum distributions of various light sources according to an embodiment.

FIG. 8 is a graph illustrating example spectrum distributions of various light sources according to an embodiment.

A light bulb A includes a distribution in which an intensity of light is linearly increased at a wavelength of 380 nm~780 nm, and is most dominant at 780 nm and infrared (IR).

A sunlight B includes an overall uniform distribution in which the intensity of light is rapidly increased at a wavelength of 380 nm~450 nm and then moderately decreased at a wavelength of 450 nm~780 nm, and is most dominant at about 450 nm and light blue.

A metal halide lamp C includes an irregular distribution in which the intensity of light at the wavelength of 380 nm~780 nm represents effective values every specific wavelengths, and is most dominant at about 550 nm and green.

A liquid crystal display (LCD) RED D includes a distribution in which the intensity of light at the wavelength of 380 nm~780 nm represents a single peak value at about 620 nm, and shows light red.

A LCD Green E includes a distribution in which the intensity of light at the wavelength of 380 nm~780 nm represents a single peak value in the vicinity of about 550 nm, and shows green.

A LCD Blue F includes a distribution in which the intensity of light represents an effective value at the wavelength of 430 nm~510 nm, and is most dominant at about 440 nm and light blue.

A light emitting diode (LED) RED G includes a distribution in which the intensity of light represents an effective value at the wavelength of 610 nm~650 nm, and is most dominant at about 630 nm and deep red.

FIGS. 9, 10, 11 and 12 are diagrams illustrating example light intensity patterns by wavelength in a fluorescent light, a halogen lamp, a cool white LED, and a warm white LED, respectively, according to various embodiments.

Figure 9:
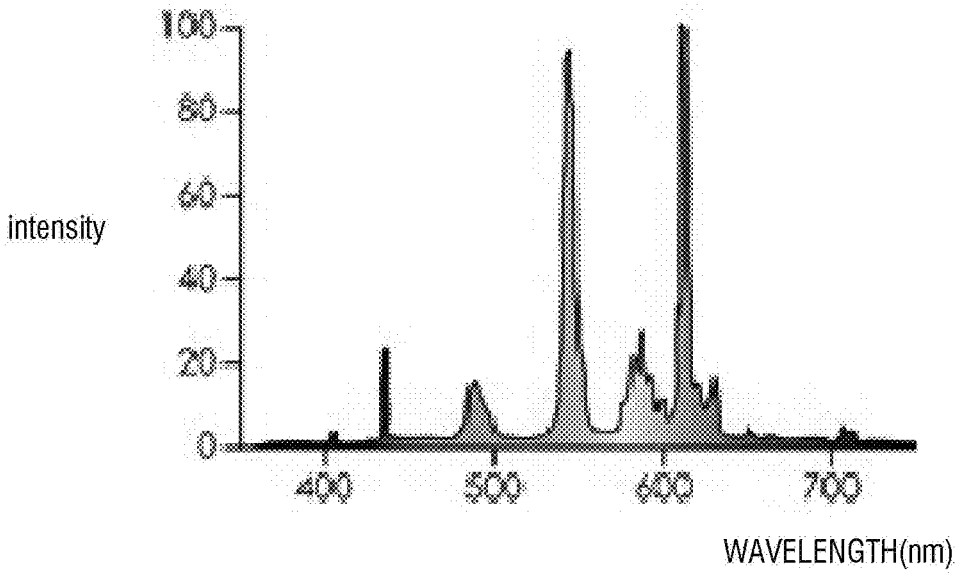
FIG. 9 is a graph illustrating an example light intensity pattern by wavelength in a fluorescent light according to an embodiment.

Referring to FIG. 9, the fluorescent light is a distribution in which the intensity of light represents an effective value at the wavelength of 550 nm~610 nm, and is most dominant at about 610 nm and orange.

Figure 10:
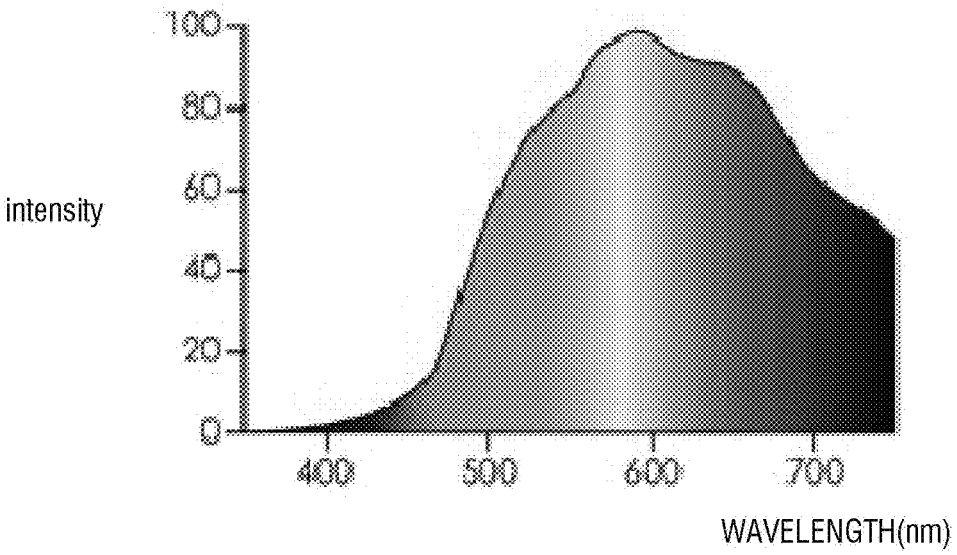
FIG. 10 is a graph illustrating an example light intensity pattern by wavelength in a halogen lamp according to an embodiment.

Referring to FIG. 10, the halogen lamp is a distribution showing a pattern in which the intensity of light is increased at a wavelength of 400 nm~600 nm and then decreased at a wavelength of 600 nm~780 nm, and is most dominant at about 600 nm and orange.

Figure 11:
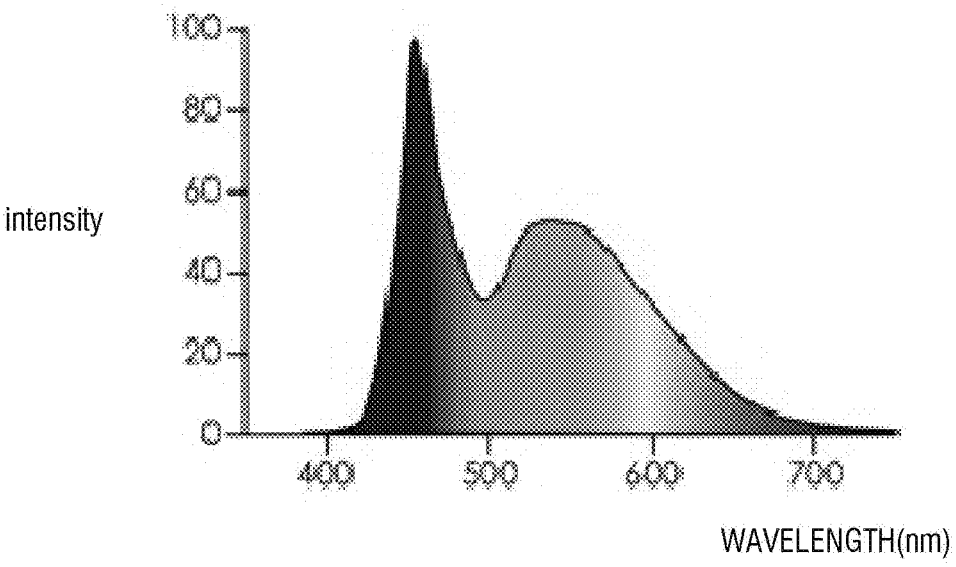
FIG. 11 is a graph illustrating an example light intensity pattern by wavelength in a cool white light emitting diode (LED) according to an embodiment.

Referring to FIG. 11, the cool white LED is a distribution showing a pattern in which the intensity of light is increased to a maximum value at a wavelength of 400 nm~450 nm and then decreased to 40% at a wavelength of 450 nm~500 nm, and increased to 50% at a wavelength of 500 nm~550 nm and then again decreased to 0% at a wavelength of 550 nm~780 nm, and is most dominant at about 450 nm and light blue.

Figure 12:
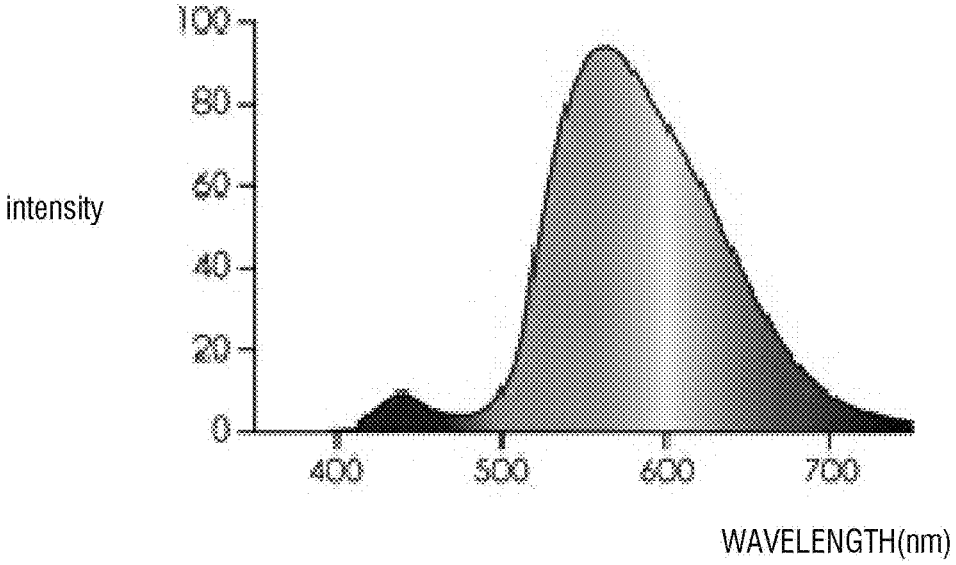
FIG. 12 is a graph illustrating an example light intensity pattern by wavelength in a warm white LED according to an embodiment.

Referring to FIG. 12, the warm white LED is a distribution showing a pattern in which the intensity of light is increased to a maximum value at a wavelength of 500 nm~560 nm and then decreased to 0% at a wavelength of 560 nm~780 nm, and is most dominant at about 560 nm and green.

Figure 13:
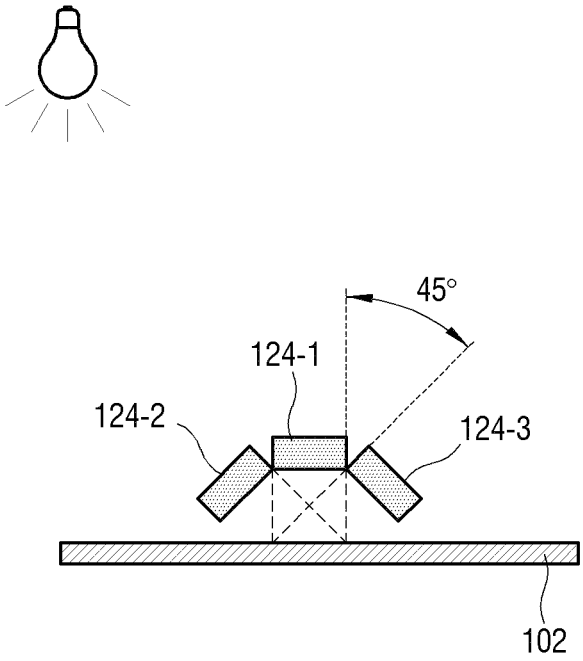
FIG. 13 is a diagram illustrating an example state in which first to third sub color sensors are arranged head-on, at an angle of 45 degrees in the left direction, and at an angle of 45 degrees in the right direction, respectively, according to an embodiment.

FIG. 13 is a diagram illustrating an example state in which first to third sub color sensors 124-1, 124-2 and 124-3 are arranged head-on, at an angle of 45 degrees in the left direction, and at an angle of 45 degrees in the right direction, respectively, according to an embodiment of the present disclosure.

The first to third sub color sensors 124-1, 124-2 and 124-3 may detect wavelengths or frequencies and intensities of input light. The processor 14 may compare the unique patterns of the light sources as shown in FIGS. 8, 9, 10, 11 and 12 described above based on the wavelengths R, G, B and IR or the frequencies and the intensities of entering light thereby to identify the kind and the direction of the entering light.

The processor 14 may identify whether the entering light is entered from a plurality of light sources or a single light source based on the wavelengths and the intensities of light detected by the first to third sub color sensors 124-1, 124-2 and 124-3.

The processor 14 may adjust the color of the image displayed on the display 15 to provide a complementary color contrast effect thereto, based on the directions of the light sources, the wavelengths or the frequencies and the intensities of entering light. In other words, the processor 14 may adjust the color of the image on the whole, uniformly or partially with respect to the screen. The color adjustment of the image may performed by controlling RGB pixels of spontaneous light emitting display elements or color filters of the LCD display elements through correction of original image data to be displayed.

Figure 14:
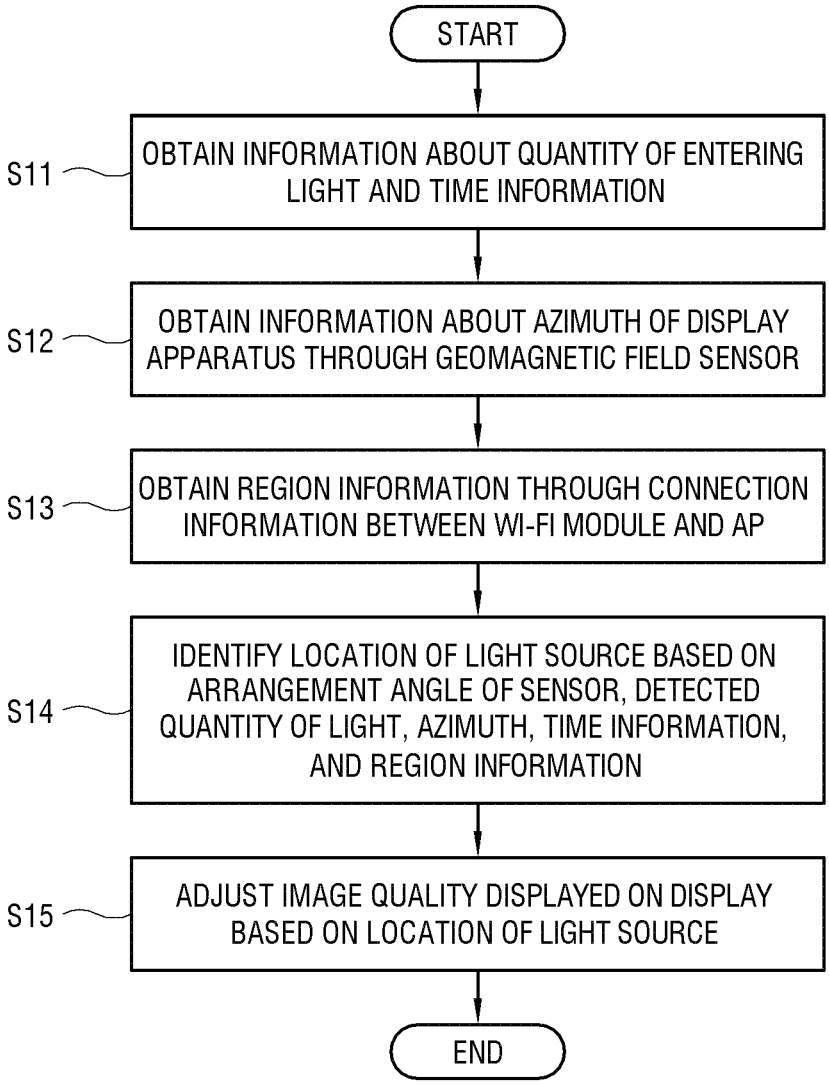
FIG. 14 is a flowchart illustrating an example method of controlling a display apparatus according to an embodiment.

FIG. 14 is a flowchart illustrating an example method of controlling the display apparatus 1 according to an embodiment of the present disclosure.

At S11, the illumination sensor 122 of the sensor 12 may detect a quantity of light entering into the display 15 to obtain the quantity of entering light according to an arrangement angle of the sensor 12 and time information.

At S12, the geomagnetic field sensor 126 may obtain information about azimuth where the display apparatus 1 is placed.

At S13, the processor 14 may obtain region information where the display apparatus 1 is located through the connection information between the Wi-Fi module and the AP, e.g., the IP address.

At S14, the processor 14 may identify a location of light source, for example, sun, based on the arrangement angle of the sensor 12, the detected quantity of light, the azimuth, the time information, the region information, etc.

At S15, the processor 14 may adjust a quality of an image displayed on the display 15 based on information about the location of light source (sun). In other words, the processor 14 may discriminatorily correct a brightness of original image data to correspond to the location of light source, and thus perform control of the backlight or brightness control of the pixels. Also, the processor 14 may display a UI having a shadow effect or a gradation effect according to the location of the light source.

Figure 15:
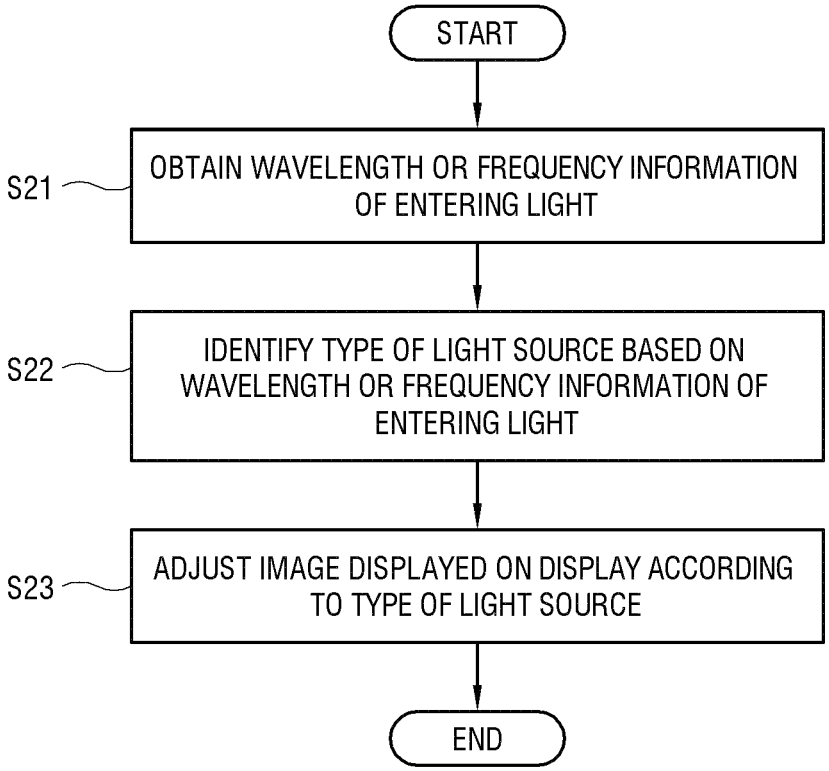
FIG. 15 is a flowchart illustrating an example method of controlling a display apparatus according to an embodiment.

FIG. 15 is a flowchart illustrating an example method of controlling the display apparatus 1 according to an embodiment of the present disclosure.

At S21, the color sensor 124 may detect a wavelength or frequency of light entering into the display 15.

At S22, the processor 14 may analyze a unique pattern of the detected wavelength or frequency of entering light to identify a type of the light source.

At S23, the processor 14 may adjust an image displayed on the display 15 according to a predominant wavelength, e.g., color, of the identified light source. The adjustment of the image may be performed by correcting original image data to obtain a complementary color contrast effect corresponding to the predominant color according to the kind of the light source and controlling the color filters of the LCD display elements or the RGB pixels of the spontaneous light emitting display elements.

The display apparatus 1 according to an embodiment of the present disclosure may individually perform the image adjustment according to the location of the light source and the image adjustment according to the wavelength of the light source, and perform an image adjustment considering them both.

As described above, the display apparatus 1 according to an embodiment of the present disclosure may adjust the image according to the location of the light source and/or the kind of the light source, thereby providing a user friendly UI/user experience (UX).

Figure 16:
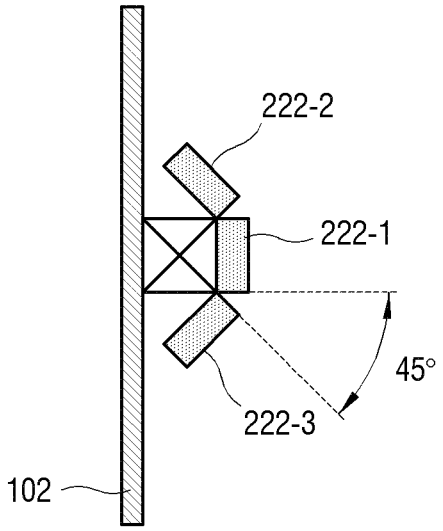
FIG. 16 is a diagram illustrating an example state in which fourth to sixth sub illumination sensors are arranged head-on, at an angle of 45 degrees in the upper direction, and at an angle of 45 degrees in the lower direction, respectively, according to an embodiment.

FIG. 16 is a diagram illustrating an example state in which fourth to sixth sub illumination sensors 222-1, 222-2 and 222-3 are arranged head-on, at an angle of 45 degrees in the upper direction, and at an angle of 45 degrees in the lower direction, respectively, according to an embodiment of the present disclosure.

Referring to FIG. 16, the processor 14 may identify a location, e.g., a vertical direction position, of the light source based on a quantity of light entering the fourth to sixth sub illumination sensors 222-1, 222-2 and 222-3.

The display apparatus 1 may use the fourth to sixth sub illumination sensors 222-1, 222-2 and 222-3 along with the first to third sub illumination sensors 122-1, 122-2 and 122-3 arranged in the predetermined arrangement angles with respect to the horizontal direction as shown in FIG. 4, thereby accurately identifying the location of the light source with respect to the upper, the lower, the left and the right directions.

FIG. 16 illustrates the illumination sensor 222 as an example, but a plurality of sub color sensors may be also applied to be arranged with respect to the upper, the lower, the left and the right directions.

Figure 17:
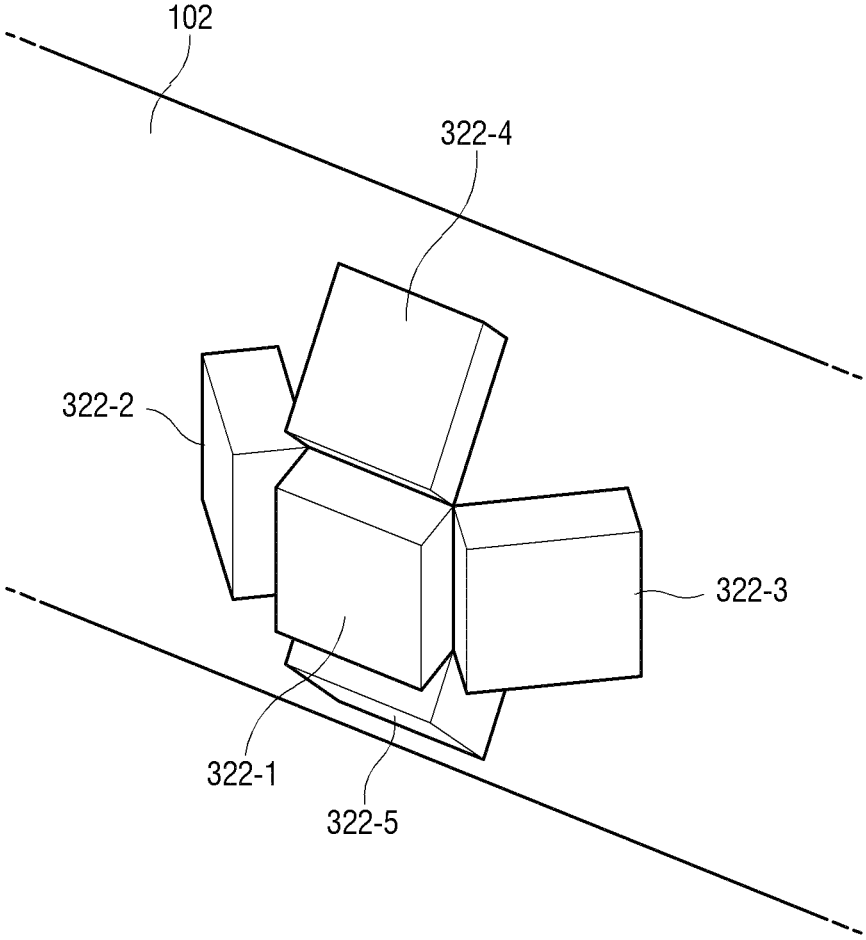
FIG. 17 is a diagram illustrating an example state in which seventh to eleventh sub illumination sensors are arranged head-on, at an angle of 45 degrees in the left direction, at an angle of 45 degrees in the right direction, at an angle of 45 degrees in the upper direction, and at an angle of 45 degrees in the lower direction, respectively, according to an embodiment.

FIG. 17 is a diagram illustrating an example state in which seventh to eleventh sub illumination sensors 322-1~322-5 are arranged head-on, at an angle of 45 degrees in the left direction, at an angle of 45 degrees in the right direction, at an angle of 45 degrees in the upper direction, and at an angle of 45 degrees in the lower direction, respectively, according to an embodiment of the present disclosure.

Referring to FIG. 17, the processor 14 may identify a location, e.g., horizontal and vertical direction positions, of the light source based on a quantity of light entering the seventh to eleventh sub illumination sensors 322-1~322-5.

As above, the processor 14 may accurately identify the location of the light source with respect to the upper, the lower, the left and the right directions based on the quantity of light detected by the seventh to eleventh sub illumination sensors 322-1~322-5.

Of course, the display apparatus 1 may include a plurality of sub color sensors arranged in predetermined arrangement angles with respect to the upper, the lower, the left and the right directions, as in FIG. 17.

The light source position identification module, the source kind identification module and the light source compensation module according to an embodiment of the present disclosure may be implemented by a computer program product, which is stored in the memory 13 or transmitted and received via the network communication, as a computer readable recording medium. Also, the modules as described above may be implemented by a computer program in which they are integrated together or configured separately.

The computer program according to an embodiment of the present disclosure may perform an operation of identifying the location of the light source based on the arrangement angle of the sensor 12 and the detected quantity of light and adjusting the quality of image to correspond the identified location of the light source, and an operation of identifying the kind of light source based on the detected wavelength or frequency of light and adjusting the quality of image to correspond the identified kind of the light source.

The display apparatus according to an embodiment of the present disclosure may accurately identify the location of the ambient light source with respect to the arrangement direction thereof thus to adjust the quality of image taking account of the effect according to the quantity of light, which is unevenly reflected on each location of the display screen.

The display apparatus may adjust the quality of image of the display based on the kind of the various light source, such as, for example, the sunlight, the fluorescent lamp, the light bulb, the LED lamp, the neon lamp, etc.

As described above, the display apparatus according to embodiments of the present disclosure may correct the effect by the difference in quantity of the entering light on each location of the display screen and the effect by the difference in color of the entering light according to the kind of the ambient light source, e.g., provide the complementary color contrast effect, thereby minimizing the influence of the external light or providing the user friendly UI/user experience (UX).

While the disclosure has been illustrated and described with reference to various example embodiments, it will be understood that the various example embodiments are intended to be illustrative, not limiting. It will be further understood by one of ordinary skill in the art that various changes in form and detail may be made without departing from the true spirit and full scope of the disclosure, including the appended claims and their equivalents.

What is claimed is:

1. A display apparatus, comprising:

a display;

a housing supporting the display;

a sensor unit disposed on the housing, wherein the sensor unit includes a first set of sensors arranged adjacent to each other on a front surface of the housing including a screen of the display and at different angles in a horizontal direction of the screen of the display and a second set of sensors arranged adjacent to each other on the front surface of the housing and at different angles in a vertical direction of the screen of the display, and each sensor of the first set of sensors and the second set of sensors is configured to detect a quantity of light entering the respective sensor; and a processor configured to:

based on at least one of the arrangements of the first set of sensors and the second set of sensors and the detected quantity of light entering each of the sensors of the first set of sensors and the second set of sensors, identify a location comprising a horizontal and vertical direction positions of a light source; and in response to the identified location of the light source, adjust a quality of an image displayed on the display;

wherein:

the sensor unit comprises a first sensor arranged toward a front direction of the screen of the display, the first set of sensors comprise a second sensor and a third sensor arranged adjacent to both sides of the first sensor in the horizontal direction of the screen of the display and an angle formed by the second sensor with respect to the first sensor and an angle formed by the third sensor with respect to the first sensor are opposite in the horizontal direction, and the second set of sensors comprise a fourth sensor and a fifth sensor arranged adjacent to both sides of the second sensor in the vertical direction of the screen of the display and an angle formed by the fourth sensor with respect to the first sensor and an angle formed by the fifth sensor with respect to the first sensor are opposite in the vertical direction, and wherein:

the first sensor is arranged on a plane parallel to the screen of the display, wherein first sides of the second sensor, the third sensor, the fourth sensor and the fifth sensor are arranged to face to the plane, the first sides being close to the first sensor, and wherein second sides of the second sensor, the third sensor, the fourth sensor and the fifth sensor are arranged to be inclined in a direction opposite to the front direction of the screen of the display, the second sides opposite to the first sides being farther from the first sensor than are the first sides.

2. The display apparatus of claim 1, wherein the first set of sensors are provided on a center of a horizontal side of the front surface of the housing.

3. The display apparatus of claim 1, wherein the first set of sensors and the second set of sensors comprise at least one of an illumination sensor or a color sensor.

4. The display apparatus of claim 1, wherein the processor is configured to adjust a color of the image based on the location of the light source.

5. The display apparatus of claim 1, further comprising:

a geomagnetic field sensor;

wherein the processor is configured to:

identify an installation azimuth of the display apparatus using the geomagnetic field sensor; and based on the identified installation azimuth, identify the location of the light source.

6. The display apparatus of claim 5, further comprising:

a Wi-Fi communication module comprising circuitry configured to perform Wi-Fi communication, wherein the processor is configured to identify an installation region of the display based on connection information with an access point (AP) in performing of the Wi-Fi communication.

7. The display apparatus of claim 1, further comprising:

a second sensor unit configured to detect at least one of a wavelength or a frequency of the entering light, wherein the processor is configured to:

based on at least one of the detected wavelength or the detected frequency of the entering light, identify a type of the light source; and based on the identified type of the light source, adjust the quality of the image.

8. The display apparatus of claim 7, wherein the processor is configured to adjust a color of the image based on the type of the light source.

9. The display apparatus of claim 1, wherein the processor is further configured to:

based on at least one of detected wavelength or detected frequency of entering light, identify a type of a light source; and in response to the identified type of the light source, adjust a quality of the image displayed on the display, wherein adjusting the quality of the image includes correcting image data of the image to obtain a complementary color contrast effect corresponding to a predominant color according to the type of the light source and controlling color filters of the elements of the display.

10. The display apparatus of claim 9, wherein the processor is configured to adjust a color of the image based on the type of the light source.

11. The display apparatus of claim 9, wherein the processor is configured to:

based on arrangement angles of the first set of sensors and the second set of sensors, identify a location of the light source; and adjust a color of the image based on the location of the light source.

12. The display apparatus of claim 1, wherein the processor is further configured to identify the location of the light source by comparing the detected quantity of light entering the first set of sensors and comparing the detected quantity of light entering the second set of sensors.

13. The display apparatus of claim 1, wherein the second sensor is arranged at a 45 degree angle to the screen of the display and the third sensor is arranged at a 135 degree angle to the screen of the display.

14. The display apparatus of claim 1, wherein the processor is configured so that adjustment of the quality of the image includes applying a gradation effect to the image by correcting data of the image based at least on the identified location of the light source and the detected quantity of light entering each of the sensors of the first set of sensors and the second set of sensors.

15. The display apparatus of claim 1, wherein the first set of sensors and the second set of sensors are configured to detect a wavelength or frequency of the entering light, and the processor is further configured to:

based on the direction of the light source, the wavelengths or the frequencies of the entering light, and intensities of the entering light, perform color adjustment of the image by controlling RGB pixels of spontaneous light emitting display elements through correction of original image data to be displayed.

16. A method of controlling a display apparatus comprising a display, a housing supporting the display, and a sensor unit disposed on the housing, wherein the sensor unit includes a first set of sensors arranged adjacent to each other on a front surface of the housing including a screen of the display and at different angles in a horizontal direction of the screen of the display and a second set of sensors arranged adjacent to each other on the front surface of the housing and at different angles in a vertical direction of the screen of the display, the method comprising:

detecting, by each sensor of the first set of sensors, a quantity of light entering the respective sensor of the first set of sensors;

detecting, by each sensor of the second set of sensors, a quantity of light entering the respective sensor of the second set of sensors;

based on the arrangement of the first set of sensors and the second set of sensors and the detected quantity of light entering each of the sensors of the first set of sensors and the second set of sensors, identifying a location comprising a horizontal and vertical direction positions of a light source; and adjusting a quality of an image displayed on the display of the display apparatus based on the identified location of the light source, and wherein:

the sensor unit comprises a first sensor arranged toward a front direction of the screen of the display, the first set of sensors comprises a second sensor and a third sensor arranged adjacent to both sides of the first sensor in the horizontal direction of the screen of the display and an angle formed by the second sensor with respect to the first sensor and an angle formed by the third sensor with respect to the first sensor are opposite in the horizontal direction, and the second set of sensors comprises a fourth sensor and a fifth sensor arranged adjacent to both sides of the second sensor in the vertical direction of the screen of the display and an angle formed by the fourth sensor with respect to the first sensor and an angle formed by the fifth sensor with respect to the first sensor are opposite in the vertical direction, and wherein:

the first sensor is arranged on a plane parallel to the screen of the display, wherein first sides of the second sensor, the third sensor, the fourth sensor and the fifth sensor are arranged to face to the plane, the first sides being close to the first sensor, and wherein second sides of the second sensor, the third sensor, the fourth sensor and the fifth sensor are arranged to be inclined in a direction opposite to the front direction of the screen of the display, the second sides opposite to the first sides being farther from the first sensor than are the first sides.

17. The method of claim 16, further, comprising:

detecting at least one of a wavelength or a frequency of the entering light;

based on at least one of the wavelength or the detected frequency of the entering light, identifying a type of a light source; and in response to the identified type of the light source, adjusting a quality of an image displayed on the display of the display apparatus, wherein adjusting the quality of the image includes correcting image data of the image to obtain a complementary color contrast effect corresponding to a predominant color according to the type of the light source and controlling color filters of the elements of the display.

18. The method of controlling the display apparatus of claim 16, wherein the identifying the location of the light source comprises identifying the location of the light source by comparing the detected quantity of light entering the first set of sensors and comparing the detected quantity of light entering the second set of sensors.

* * * * *